US006649922B1

(12) United States Patent
McKenzie

(10) Patent No.: US 6,649,922 B1
(45) Date of Patent: Nov. 18, 2003

(54) PACKAGING SYSTEM AND METHOD FOR SHIELDING BRACHYTHERAPY SEEDS AND OTHER RADIATION-EMITTING SOURCES

(76) Inventor: Robert McKenzie, 5809 Galleon Way, Tampa, FL (US) 33615

( * ) Notice: Subject to any disclaimer, the term of this patent is extended or adjusted under 35 U.S.C. 154(b) by 0 days.

(21) Appl. No.: 10/281,506

(22) Filed: Oct. 29, 2002

(51) Int. Cl.[7] ..... G21F 5/00

(52) U.S. Cl. ..... 250/506.1; 250/505.1; 250/515.1

(58) Field of Search ..... 290/505.1, 506.1, 290/515.1

(56) References Cited

U.S. PATENT DOCUMENTS 3,845,316 A * 10/1974 Tureck ..... 250/519.1
3,899,677 A * 8/1975 Hori et al. ..... 250/474.1
4,282,441 A * 8/1981 Filoramo ..... 250/515.1
4,333,010 A * 6/1982 Miller ..... 250/252.1
4,546,251 A * 10/1985 Schaffer ..... 250/252.1

* cited by examiner

*Primary Examiner*—John R. Lee
*Assistant Examiner*—Paul M. Gurzo
(74) *Attorney, Agent, or Firm*—Stanley M. Miller

(57) ABSTRACT

A shielded packaging system is formed by a top panel and a bottom panel that are connected to one another along a preselected extent of their respective peripheral edges. An opening is formed along the unconnected extent and provides access to the space between the panels that holds radioactive items. Each panel includes at least two layers of lead foil so that if a pinhole is formed in either layer, the probability of two pinholes lining up and enabling radiation to escape from the space is minimal. The layers of lead foil have at least one ridge formed in them at their respective peripheral edges so that radiation traveling in a straight path parallel to the top and bottom panels encounters the ridges and cannot escape through the edges of the package.

20 Claims, 1 Drawing Sheet

PACKAGING SYSTEM AND METHOD FOR SHIELDING BRACHYTHERAPY SEEDS AND OTHER RADIATION-EMITTING SOURCES

BACKGROUND OF THE INVENTION

1. Field of the invention

This invention relates, generally, to the art of packaging. More particularly, it relates to a packaging system and method for shielding items that emit radiation.

2. Description of the prior art

U.S. Pat. No. 3,845,316 discloses a coated lead foil for protecting photographic film from X-ray machines. If a pinhole is formed in such a package, the likelihood of radiation from an X-ray machine entering into the interior of the package through said pinhole and damaging the film is quite remote. Thus, such packaging adequately protects film from X-rays.

However, if the film is replaced by a source of radiation, the presence of a pinhole becomes unacceptable because radiation is likely to travel through the pinhole and expose the handlers of the package to radiation. Thus, the known packaging is inadequate to protect handlers of the package from X-rays that originate from within the package.

The peripheral edges of conventional lead foil packages are heat sealed and are flat, i.e., the edges lie in the same plane as the main body of the package. A source of radiation emits radiation in all directions. Accordingly, some radiation will travel in a straight line that is parallel to the top and bottom panels of such packages, and pass through the flat edges into the ambient environment through the heat seal. The plastic that seals the edges of the package offers insignificant resistance to radiation passing therethrough.

Many surgical supplies such as sutures, specialty items, and the like are delivered to hospitals in special packaging. These packages keep sterile items sterile and enable such items to be used immediately upon removal from the packaging, there being no need to undergo preparatory steps after opening the packaging. Typically, a package of this type is made by laminating a standard lead foil to plastic and sealing the package to form a pouch.

Items that are sources of nuclear radiation, however, are not delivered in such packages because of the above-noted pinhole problem and because the flat, heat-sealed edges of such packages would enable radiation to escape into the environment as above-noted. The slightest defect in packaging is unacceptable for such items. Instead, radioactive items are delivered in specially shielded containers. Various designs have been created to enable the person opening such a shielded container to transfer its contents quickly to a shielded tool or other device that uses the radioactive material.

For example, radioactive brachytherapy seeds are usually sent to hospitals in non-sterile vials within which the seeds are loosely contained. Upon receipt of such vials, the hospital staff needs to autoclave the seeds to sterilize them. Someone must then deliver the seeds to the operating room. The seeds are loaded into needles in the operating room where they are implanted into the cancerous prostate gland of a patient, for example.

It would be advantageous if radioactive materials could be delivered in sterile condition in packages similar to the packages used to deliver non-radioactive items. An improved packaging system would obviate the need for the shielded containers and devices for transferring radioactive items from such shielded containers to the tools within which they are used. It would also eliminate the need for the recipient of the package to sterilize the contents of the package.

Moreover, if a package could be provided that would eliminate the radiation-leakage problem, then the radioactive materials could be sterilized and packaged at a central location, thereby reducing the amount of operating room time spent on such tasks.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a shielded packaging system is now met by a new, useful, and nonobvious shielded packaging system formed by securing to one another a pair of abutting panels about their respective peripheries. A first panel includes a first layer of plastic, a first layer of lead foil, and a first layer of adhesive disposed between the first layer of plastic and the first layer of lead foil. The first panel further includes a second layer of lead foil, a second layer of adhesive disposed between the first layer of lead foil and the second layer of lead foil, a second layer of plastic, and a third layer of adhesive disposed between the second layer of lead foil and the second layer of plastic. Each of the layers is collectively positioned in a common, substantially flat plane.

The second panel has the same construction as the first panel and the panels are joined to one another about a predetermined extent of their respective peripheral edges so that an opening is defined where the respective peripheral edges are not joined to one another. Radioactive materials are thus inserted into the package through the opening and the opening is then closed.

Each panel of the shielded packaging system includes at least two layers of lead foil so that a pinhole that might be formed in the first layer of lead foil is unlikely to be in alignment with a pinhole that might be formed in the second layer of lead foil.

The respective peripheral edges of the first and second layers of lead foil of each panel are offset relative to the substantially flat plane of the packaging system so that radiation traveling in a straight line parallel to the substantially flat plane cannot escape into an ambient environment through the respective peripheral edges.

More particularly, a fold is formed in the shielded packaging system to close the opening. The fold is formed in at least two layers of lead foil of each panel so that radiation traveling in a straight line parallel to the substantially flat plane cannot escape into an ambient environment through the fold.

The first and second layers of plastic are made of a flame retardant, heat-sealable plastic, preferably polyvinylchloride. The first and second layers of plastic preferably have a thickness of about 0.0035 inch.

The first and second layers of lead foil have a thickness of at least about 0.005 inch.

The steps of the novel method for sealing radioactive items in a container include the steps of providing a first panel including a first layer of plastic, providing a first layer of lead foil, positioning a first layer of adhesive between the first layer of plastic and the first layer of lead foil, providing a second layer of lead foil, positioning a second layer of adhesive between the first layer of lead foil and the second layer of lead foil, providing a second layer of plastic, positioning a third layer of adhesive between the second layer of lead foil and the second layer of plastic, and positioning the layers collectively in a common, substantially flat plane to form a first panel.

The second panel is made in the same way and the first and second panels are joined to one another about a predetermined extent of their respective peripheral edges so that an opening is defined where the respective peripheral edges are not joined to one another and so that a pinhole that might be formed in a first layer of lead foil is unlikely to be in alignment with a pinhole that might be formed in a second layer of lead foil.

The novel method further includes the step of offsetting the respective peripheral edges of the first and second layers of lead foil of each panel relative to the substantially flat plane of the packaging system so that radiation traveling in a straight line parallel to the substantially flat plane cannot escape into an ambient environment through the respective peripheral edges.

The offsetting step is performed by forming a fold in the shielded packaging system to close the opening. The fold is formed in the at least two layers of lead foil of each panel so that radiation traveling in a straight line parallel to said substantially flat plane cannot escape into an ambient environment through the fold.

The method steps further include the step of making the first and second layers of plastic of a flame retardant, heat-sealable plastic such as polyvinylchloride having a thickness of about 0.0035 inch, and making the first and second layers of lead foil so that each of said layers has a thickness of at least about 0.005 inch.

An important object of this invention is to provide a packaging system that successfully shields radioactive seeds or other radioactive items and that can be presented to an operating room or operating room physician in a sterile, ready-to-use condition.

A closely related object is to reduce the time that radioactive items are handled by hospital and operating room staff.

A more specific object is to eliminate the need for an operating room staff to autoclave radioactive items.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
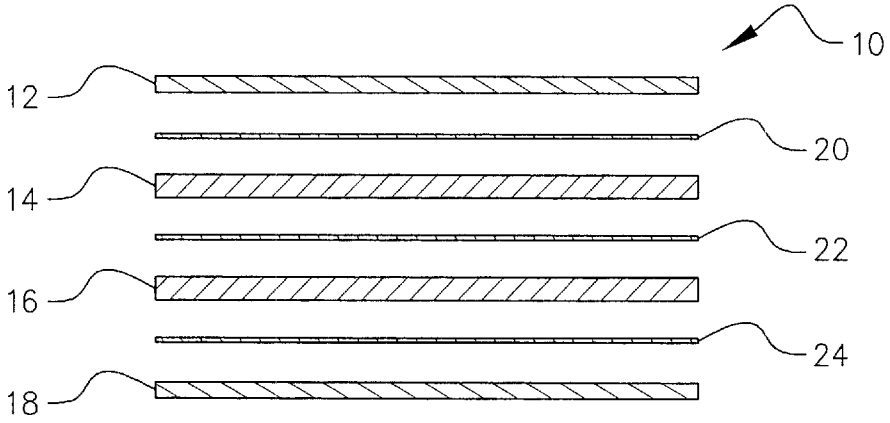
FIG. 1 is a side elevational, exploded view of one panel of the novel packaging system.

Referring to FIG. 1, it will there be seen that the reference numeral 10 denotes an illustrative embodiment of the present invention as a whole.

Novel package 10 includes a first panel that includes a layer of flame retardant heat-sealable plastic 12, a first layer of lead foil 14, a second layer of lead foil 16, and a second layer of flame retardant heat-sealable plastic 18. A first layer of adhesive 20 bonds together plastic 12 and lead foil 14, a second layer of adhesive 22 bonds together first layer of lead foil 14 and second layer of lead foil 16, and a third layer of adhesive 24 bonds together second layer of lead foil 16 and said second layer of plastic 18. A second panel, not shown, has the same construction as the first panel.

For radiation to escape through a panel having two lead foils, there would have to be a pinhole in first lead foil 14, a pinhole in second lead foil 16, and both pinholes would have to line up with one another because radiation travels in a straight line. The probability of two independently manufactured sheets of lead foil having pinholes that are in juxtaposition with one another when the two sheets are laminated together is essentially zero.

First plastic sheet 12 has a thickness of about 3.5 mils, as does second plastic sheet 18. The plastic is preferably polyvinylchloride (PVC).

First lead foil 14 has a thickness of at least about 5.0 mils (0.005 inch), as does second lead foil 16. The thickness of each lead foil could be increased for extra protection. One or more extra layers of lead foil could also be added for the same reason, each layer being joined to its contiguous layer by a layer of adhesive.

Figure 2:
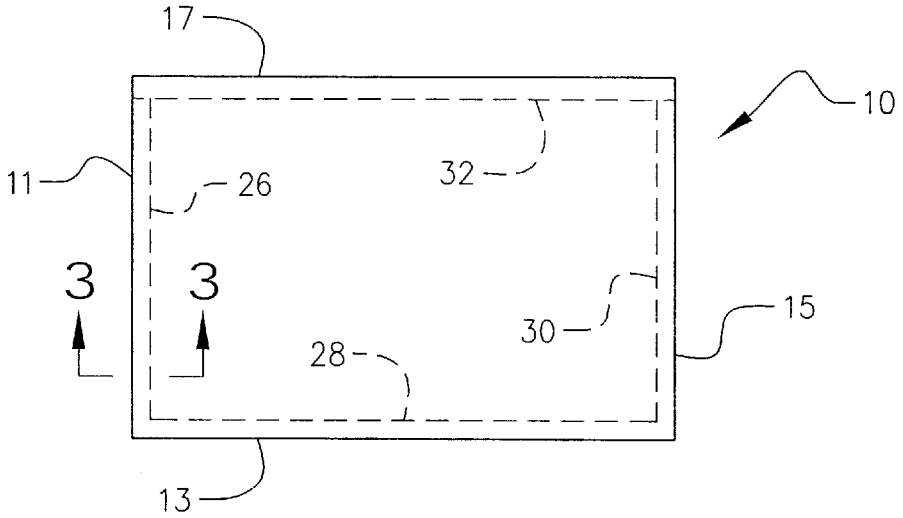
FIG. 2 is a top plan view thereof.

As indicated in FIG. 2, bag or pouch 10 is formed by heat-sealing three peripheral edges 11, 13, 15 of two facing panels together, leaving edge 17 unsealed to serve as the opening of the pouch.

Pouch 10 need not be rectangular in configuration, said shape merely being a common shape selected for ease of illustration. Oval, triangular, and pouches of other shapes as well can also be constructed by joining together preselected edges of a laminated assembly of the type taught herein and leaving unjoined a preselected extent thereof to provide an opening.

A ridge or ridges are formed in sealing lines 26, 28, and 30 and said ridge or ridges forces the lead foil laminates 14, 16 into the plane of the seal, thereby preventing radiation leakage through the sealed edge.

Figure 3:
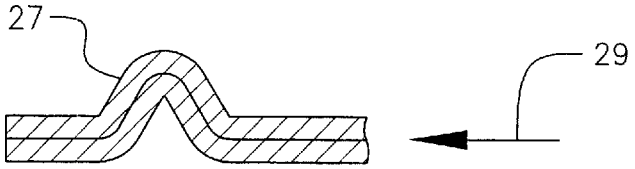
FIG. 3 is a side elevational view taken along line 3—3 in FIG. 2.

FIG. 3 depicts a ridge 27 formed in lead foil layers 14, 16 that prevents radiation 29 from escaping from the confines of the pouch by traveling in a straight line parallel to the plane of the pouch and out a peripheral edge thereof.

A folding line 32 is formed in parallel relation to the unsealed edge so that the structure may be folded along said line 32 and taped shut. In the alternative, the opening may be folded and heat sealed. Either way, the fold is formed in the lead foil to prevent the escape of radiation traveling in a straight line in parallel relation to the top and bottom panels of the package. The radioactive material is completely shielded and encased within container or pouch 10.

No cutting action is required to open package 10. This is advantageous because cutting lead foil with scissors and knives is difficult.

Upon receipt of pouch 10, a physician merely needs to open it and use the sterile, radioactive items therewithin, just as is done with non-radioactive supplies or tools.

The radioactive items inside pouch 12 may be placed into vials, needles, cartridges, eye plaques, and the like. Such vials or other containment devices are wrapped in single or double wrapped sterilization bags. Such sterilization bags may be covered in lead foil as well or they may, as is more typical, have a lead foil strip that covers the radioactive part of the sterilized item for further protection of the user. The items may be gamma, e.t.o., or autoclave sterilized.

For the convenience of the physician, radioactive seeds placed within needles or cartridges may be placed in a numbered card or membrane tray before insertion into the above-mentioned single or double-wrapped sterilization bags.

The novel foil pouch may be enhanced by providing sterilization indicators and patient labels to eliminate doubt as to whether or not the contents have been sterilized and to eliminate confusion concerning for which patient the contents of the pouch are intended.

Foil pouch 10, when ready for shipping, is placed in a box and secured in place by a foam cushion. The box is then placed within a shipping box and tested to determine if it meets Department of Transportation and IATA regulations for shipping radioactive material.

In this way, hospital personnel open the shipping container and deliver the lead foil pouch to the physician in the operating room. Upon opening the packaging, the presterilized contents are ready for use.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A shielded packaging system formed by securing to one another a pair of abutting panels about their respective peripheries, wherein each panel comprises:

a first layer of plastic;

a first layer of lead foil;

a first layer of adhesive disposed between said first layer of plastic and said first layer of lead foil;

a second layer of lead foil;

a second layer of adhesive disposed between said first layer of lead foil and said second layer of lead foil;

a second layer of plastic;

a third layer of adhesive disposed between said second layer of lead foil and said second layer of plastic;

said layers collectively positioned in a common, substantially flat plane; and said panels being joined to one another about a predetermined extent of their respective peripheral edges;

an opening defined where said respective peripheral edges are not joined to one another;

each panel of said shielded packaging system including said first and second layers of lead foil so that if a pinhole is formed in said first layer of lead foil it will not be in alignment with a pinhole that is formed in said second layer of lead foil, other than by pure chance.

2. The shielded packaging system of claim 1, wherein said respective peripheral edges of said first and second layers of lead foil of each panel are offset relative to said substantially flat plane of said packaging system so that radiation traveling in a straight line parallel to said substantially flat plane cannot escape into an ambient environment through said respective peripheral edges.

3. The shielded packaging system of claim 2, further comprising a fold formed in said shielded packaging system to close said opening, said fold being formed in said at least two layers of lead foil of each panel so that radiation traveling in a straight line parallel to said substantially flat plane cannot escape into an ambient environment through said fold.

4. The shielded packaging system of claim 1, wherein said first layer of plastic is made of a flame retardant, heat-sealable plastic.

5. The shielded packaging system of claim 4, wherein said first layer of plastic is formed of a flame retardant, beat sealable polyvinylchloride.

6. The shielded packaging system of claim 4, wherein said first layer of plastic is made of a flame retardant, heat-sealable plastic having a thickness of about 0.0035 inch.

7. The shielded packaging system of claim 1, wherein said second layer of plastic is made of a flame retardant, heat-sealable plastic.

8. The shielded packaging system of claim 7, wherein said second layer of plastic is formed of a flame retardant, heat sealable polyvinylchloride.

9. The shielded packaging system of claim 1, wherein said second layer of plastic is made of a flame retardant, heat-sealable plastic having a thickness of about 0.0035 inch.

10. The shielded packaging system of claim 1, wherein said first layer of lead foil has a thickness of at least about 0.005 inch.

11. The shielded packaging system of claim 1, wherein said second layer of lead foil has a thickness of at least about 0.005 inch.

12. A method for sealing radioactive items in a container, comprising the steps of:

providing a first layer of plastic;

providing a first layer of lead foil;

positioning a first layer of adhesive between said first layer of plastic and said first layer of lead foil;

providing a second layer of lead foil;

positioning a second layer of adhesive between said first layer of lead foil and said second layer of lead foil;

providing a second layer of plastic;

positioning a third layer of adhesive between said second layer of lead foil and said second layer of plastic;

positioning said layers collectively in a common, substantially flat plane to form a first panel;

performing the same steps to form a second panel; and joining said first and second panels to one another about a predetermined extent of their respective peripheral edges so that an opening is defined where said respective peripheral edges are not joined to one another and so that if a pinhole is formed in said first layer of lead foil it will not be in alignment with a pinhole that is formed in said second layer of lead foil, other than by pure chance.

13. The method of claim 12, further comprising the step of offsetting said respective peripheral edges of said first and second layers of lead foil of each panel relative to said substantially flat plane of said packaging system so that radiation traveling in a straight line parallel to said substantially flat plane cannot escape into an ambient environment through said respective peripheral edges.

14. The method of claim 13, further comprising the step of forming a fold in said shielded packaging system to close said opening, said fold being formed in said at least two layers of lead foil of each panel so that radiation traveling in a straight line parallel to said substantially flat plane cannot escape into an ambient environment through said fold.

15. The method of claim 12, further comprising the step of making said first layer of plastic of a flame retardant, heat-sealable plastic.

16. The method of claim 15, further comprising the step of making said first layer of plastic of a flame retardant, heat sealable polyvinylchloride.

17. The method of claim 12, further comprising the step of making said second layer of plastic of a flame retardant, heat-sealable plastic.

18. The method of claim 17, further comprising the step of making said second layer of plastic of a flame retardant, heat sealable polyvinylchloride.

19. The method of claim 12, further comprising the steps of making said first layer of plastic of a plastic having a thickness of about 0.0035 inch and making said second layer of plastic of a plastic having a thickness of about 0.0035 inch.

20. The method of claim 12, further comprising the step of making said first and second layers of lead foil so that each has a thickness of at least about 0.005 inch.

* * * * *